US010657940B1

(12) United States Patent
Calder

(10) Patent No.: US 10,657,940 B1
(45) **Date of Patent: *May 19, 2020**

(54) MODULAR ELECTRIC GUITAR PEDALBOARD

(71) Applicant: Jerry L. Calder, Glen Allen, VA (US)

(72) Inventor: Jerry L. Calder, Glen Allen, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,455

(22) Filed: Jun. 27, 2019

Related U.S. Application Data

(63) Continuation of application No. 16/248,249, filed on Jan. 15, 2019, now Pat. No. 10,380,984.

(60) Provisional application No. 62/618,983, filed on Jan. 18, 2018.

(51) Int. Cl.
*G10H 1/34* (2006.01)
*G10H 1/00* (2006.01)

(52) U.S. Cl.
CPC ..... *G10H 1/34* (2013.01); *G10H 1/0008* (2013.01); *G10H 2220/265* (2013.01)

(58) Field of Classification Search
CPC ... G10H 1/34; G10H 1/0008; G10H 2220/265
USPC ..... 84/746
See application file for complete search history.

(56) References Cited

U.S. PATENT DOCUMENTS 4,445,415 A * 5/1984 Izquierdo ..... G10H 1/32 206/314
5,866,829 A * 2/1999 Pecoraro ..... G10H 1/32 84/177
6,215,055 B1 * 4/2001 Saravis ..... G10H 1/348 84/422.1
6,459,023 B1 * 10/2002 Chandler ..... G10H 1/32 84/177
6,538,185 B1 * 3/2003 Stratton ..... G10H 1/32 84/422.1
6,545,204 B1 * 4/2003 Wadell ..... G10H 1/348 84/422.1
7,326,849 B2 * 2/2008 Adams ..... G10H 1/0066 84/743
7,608,776 B2 * 10/2009 Ludwig ..... G10H 1/32 84/721
7,820,904 B1 * 10/2010 Robling ..... G10H 3/186 84/600
8,138,406 B2 * 3/2012 Vinciguerra ..... G10H 1/0091 84/421
8,525,015 B2 * 9/2013 Armstrong ..... G10H 1/348 381/118
8,614,385 B2 * 12/2013 McKinney ..... G10H 1/348 84/453

(Continued)

*Primary Examiner* — David S Warren
(74) *Attorney, Agent, or Firm* — Perkins Coie LLP

(57) ABSTRACT

A modular instrument pedalboard is provided. The modular instrument pedalboard provides a plurality removably connectable pods, which may be effect pedal pods, power distribution pods, audio distribution pods, power/audio distribution pods, or a combination thereof. The pods include a base that has a first part of a connector that is adapted to be coupled to a second part of the connector which allows the pods to be connected, rearranged, expanded, contracted, and/or a combination thereof. Further the connectable pods include a circuit board to for parts of one or more audio loops as well as a power bar to transmit audio signals and power between pods.

16 Claims, 14 Drawing Sheets

(56) References Cited

U.S. PATENT DOCUMENTS 8,642,870 B1 * 2/2014 Rosa ..... A47G 27/0212 84/453
9,075,404 B2 * 7/2015 McMillen ..... G10H 1/348
9,524,707 B2 * 12/2016 Urry ..... G10H 1/06
9,595,248 B1 * 3/2017 Classe ..... G10H 1/0008
9,620,094 B2 * 4/2017 Abbate ..... G10H 1/32
9,800,357 B2 * 10/2017 Tillman ..... H04H 60/05
9,892,720 B2 * 2/2018 Packouz ..... G10H 1/348
9,905,210 B2 * 2/2018 Packouz ..... G10H 1/42
9,947,302 B2 * 4/2018 Canivell Grifols ..... G10H 1/32
9,997,149 B2 * 6/2018 Trifilio ..... G10D 1/085
10,008,192 B2 * 6/2018 Kreifeldt ..... G10H 1/348
10,163,430 B2 * 12/2018 Jashyn ..... G10H 1/348
10,170,092 B2 * 1/2019 Mayo ..... G10H 1/0008
10,192,536 B1 * 1/2019 Jia ..... G10H 1/0008
10,380,984 B1 * 8/2019 Calder ..... G10H 1/34
2002/0005111 A1 * 1/2002 Ludwig ..... G10H 1/00 84/645
2003/0066410 A1 * 4/2003 Stratton ..... G10H 1/32 84/422.1
2007/0295190 A1 * 12/2007 Collins ..... G10H 1/32 84/422.1
2009/0183625 A1 * 7/2009 Sanders ..... G10H 1/0091 84/626
2009/0188378 A1 * 7/2009 Folkesson ..... G10H 1/34 84/615
2011/0271821 A1 * 11/2011 McKinney ..... G10H 1/348 84/746
2011/0303077 A1 * 12/2011 Vinciguerra ..... G10H 1/0091 84/746
2014/0109753 A1 * 4/2014 Ludwig ..... G10H 1/32 84/644
2014/0131543 A1 * 5/2014 Goto ..... F16M 11/043 248/429
2015/0325224 A1 * 11/2015 Manosa Ripoll ..... G10H 1/32 84/444
2016/0260422 A1 * 9/2016 Canivell Grifols ..... G10H 1/32
2016/0293151 A1 * 10/2016 Mayo ..... G10H 1/0058
2017/0092251 A1 * 3/2017 Mizrahi ..... G10H 1/348
2017/0243572 A1 * 8/2017 Trifilio ..... G10D 1/085
2017/0324494 A1 * 11/2017 Tillman ..... H04H 60/05
2018/0197512 A1 * 7/2018 Perez ..... G10H 1/0058
2018/0254030 A1 * 9/2018 Mayo ..... G10H 1/0008
2018/0261197 A1 * 9/2018 Ceccolini ..... G10H 1/348
2018/0301131 A1 * 10/2018 Jashyn ..... G10H 1/348
2018/0330706 A1 * 11/2018 Leff ..... G10H 1/348

* cited by examiner

MODULAR ELECTRIC GUITAR PEDALBOARD

CROSS-REFERENCE TO RELATED PATENT APPLICATIONS

This application is a continuation of U.S. patent application Ser. No. 16/248,249, entitled "MODULAR ELECTRIC GUITAR PEDALBOARD," filed Jan. 15, 2019, which claims priority to U.S. Patent Application No. 62/618,983, entitled "MODULAR ELECTRIC GUITAR PEDALBOARD," filed Jan. 18, 2018, which are herein incorporated by reference in their entireties.

BACKGROUND

A conventional electric guitar may be integrated with an effects pedal. An effects pedal for an electric guitar may include a reverb pedal, a distortion pedal, sometimes referred to as overdrive or a "fuzz" pedal, a wah-wah pedal, a boost pedal, a compressor, a noise gate, a filter pedal, an equalizer, a chorus pedal, a flange, etc. While a single pedal is useful, many guitarists use multiple effects pedals to customize a sound or to change sounds during a performance.

A pedalboard may be used if a guitarist uses multiple pedals to organize the pedals and to inhibit the pedals from movement during a performance. A pedalboard is generally a flat board, such as wood, fiberglass, or a composite, that anchors the different effect pedals. Typically, a power distribution unit is connected to the various effect pedals mounted on the board to provide the necessary power.

FIG. 1 shows a conventional pedalboard 10. The conventional pedalboard has a flat board 12, which happens to be framed by metal. The board 12 mounts a power distribution unit 14 that receives grid or line power from a plug 16. The pedalboard 10 has a plurality of effects pedals 18 mounted to the flat board 12. The power distribution unit 14 has a plurality of cables 20 that supply power at the appropriate voltage to the different effects pedals 18.

As can be appreciated, FIG. 1 shows a relatively small pedalboard 10 for convenience. Conventional pedalboards can be massive, such as the conventional pedalboard 22 shown in FIG. 2.

Pedalboards, whether small or large, are generally customized to a particular guitarist's likes and desires, although there are certain conventions in the industry that are generally known and not relevant to an understanding of the present technology. While effective, conventional pedalboards also are inflexible. Thus, as a guitarist's ability grows such that the guitarist wants to add effects, or as the guitarist's likes and desires for guitar effects changes such that the order or arrangement might change, the guitarist is presented with a Hobson's choice of sorts. The Hobson's choice is to NOT make the change and stick with the current pedalboard, which is unsatisfactory, or scrap the current pedalboard and construct a completely new board, which is both wasteful and costly.

U.S. Pat. No. 6,459,023, issued Oct. 1, 2002, attempts to solve at least some of the above referenced problems. The '023 Patent provides a pedalboard that has a left member and a right member coupling a plurality of horizontal members separated by a gap forming a plurality of rails. At least one of the left or right member is removable. The effect pedals slide onto the pedalboard using the rails, but they are otherwise conventionally connected to a power distribution system. U.S. Pat. No. 8,138,406, issued Mar. 20, 2012, also attempts to solve at least some of the above referenced problems. The '023 Patent provides an extension board that may be hooked onto existing pedalboards to provide additional space for new effects pedals. As can be appreciated, neither of the above referenced patents satisfactory addresses the above described issues. Thus, against this background, an improved modular pedalboard is desirable.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a modular pedalboard is provided. The modular pedalboard is formed by a plurality of pods removably coupled together. The pods include circuit boards to form portions of audio loops to receive an instrument audio signal and transmit the instrument audio signal to an activated effects pedal and/or pass the instrument audio signal downstream to the next pod. The circuit boards also provide a power bar or terminal that provides power to an attached effects pedal and passes the power downstream to the next pod.

In certain aspects, the modular pedalboard provides a power distribution pod and an audio distribution pod, which may be combined into a single power/audio distribution pod, and at least one effects pedal pods. The audio distribution pod or combined power/audio distribution pod may provide for a single audio loop or multiple audio loops. The power distribution pod or the combined power/audio distribution pod may provide a power outlet such that the power or power/audio distribution pod provides power to effects pedals and peripherals.

In certain aspects of the technology the pods are interchangeable. The pods may include a base and a pod plate. Each pod base having a least a first part of a connector adapted to receive a second part of the connector. The pod base containing the circuit board and having a channel to receive cables to allow the circuit board to be coupled to downstream and upstream pods. The circuit board also having a connector to couple to the effect pedal coupled to the pod plate. The pod plate having a port to allow cables to pass from the circuit board to the effect pedal such that the effect pedal receives power and the instrument audio as well as return a modified instrument audio signal. The first part to the connector may be a slot and the second part of the connector may be a key adapted to be received in the slot. In certain embodiments, the second part of the connector is a protrusion integral with the base that is receivable in the slot of another pod.

In certain aspects of the technology, the power or power/audio distribution pod receives a voltage and transmits a DC voltage to the distribution pods circuit board. An isolated DC to DC switching power supply is incorporated into each distribution pod. The DC output voltage can be selected to output 5 volts, 9 volts, 12 volts, 15 volts, 18 volts or the like for each distribution pod. The voltage received from a previous pod such that the voltage available at the pod and/or downstream of the pod may be different than the voltage received.

In certain aspects, the pods have a wedge to receive the pod plate such that the pod comprises a base, a wedge, and a pod plate to which an effect pedal is attached. The wedge may provide angulation such that the effect pedal is presented to the user at an angle, that may range between about 0° (which is flat) to about 45°. The technology may include blocks, such as bosses or oversized buttons, to facilitate operation of the effect pedals. The pods may be arranged in a single or multiple rows.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

Figure 11A:
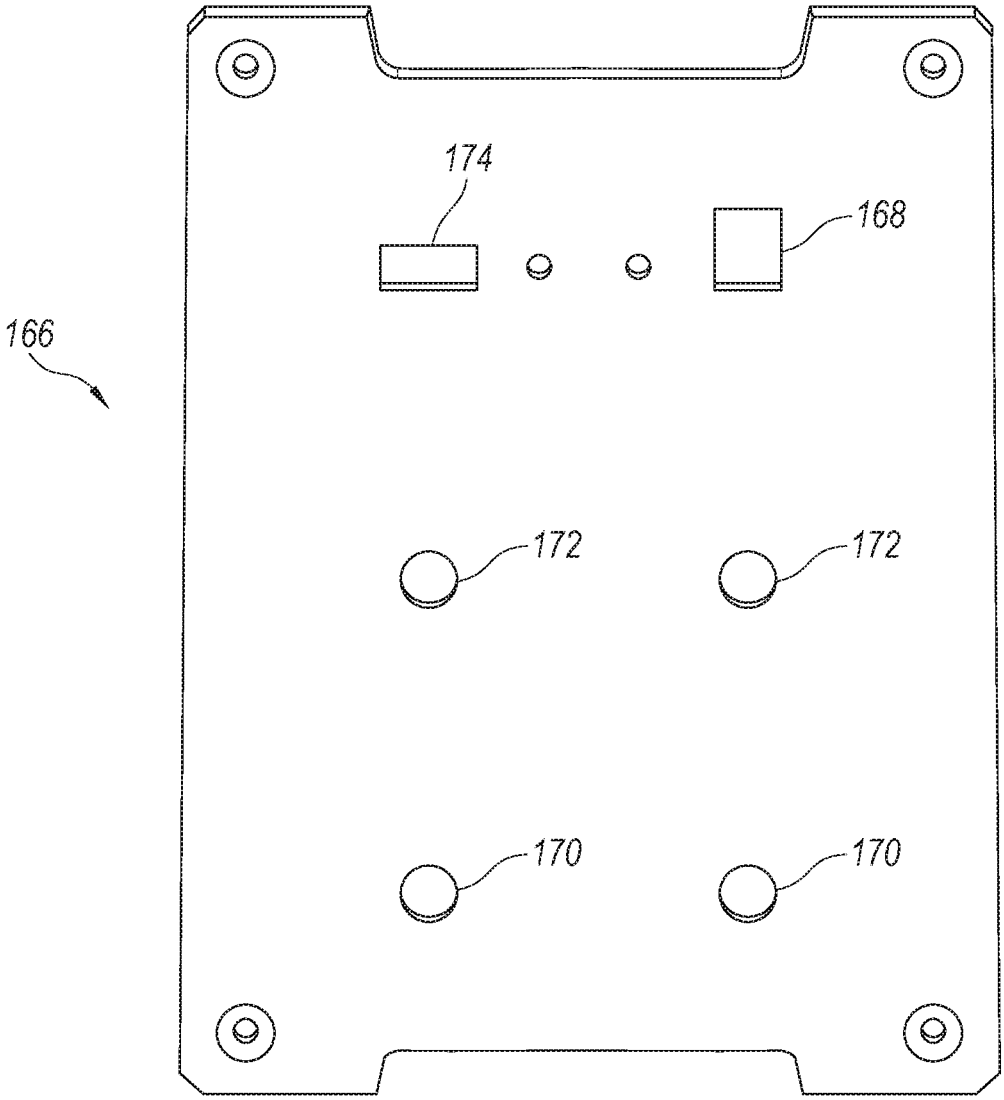

FIG. 11*a* is an input/output plate consistent with the technology of the present application.

Figure 11B:
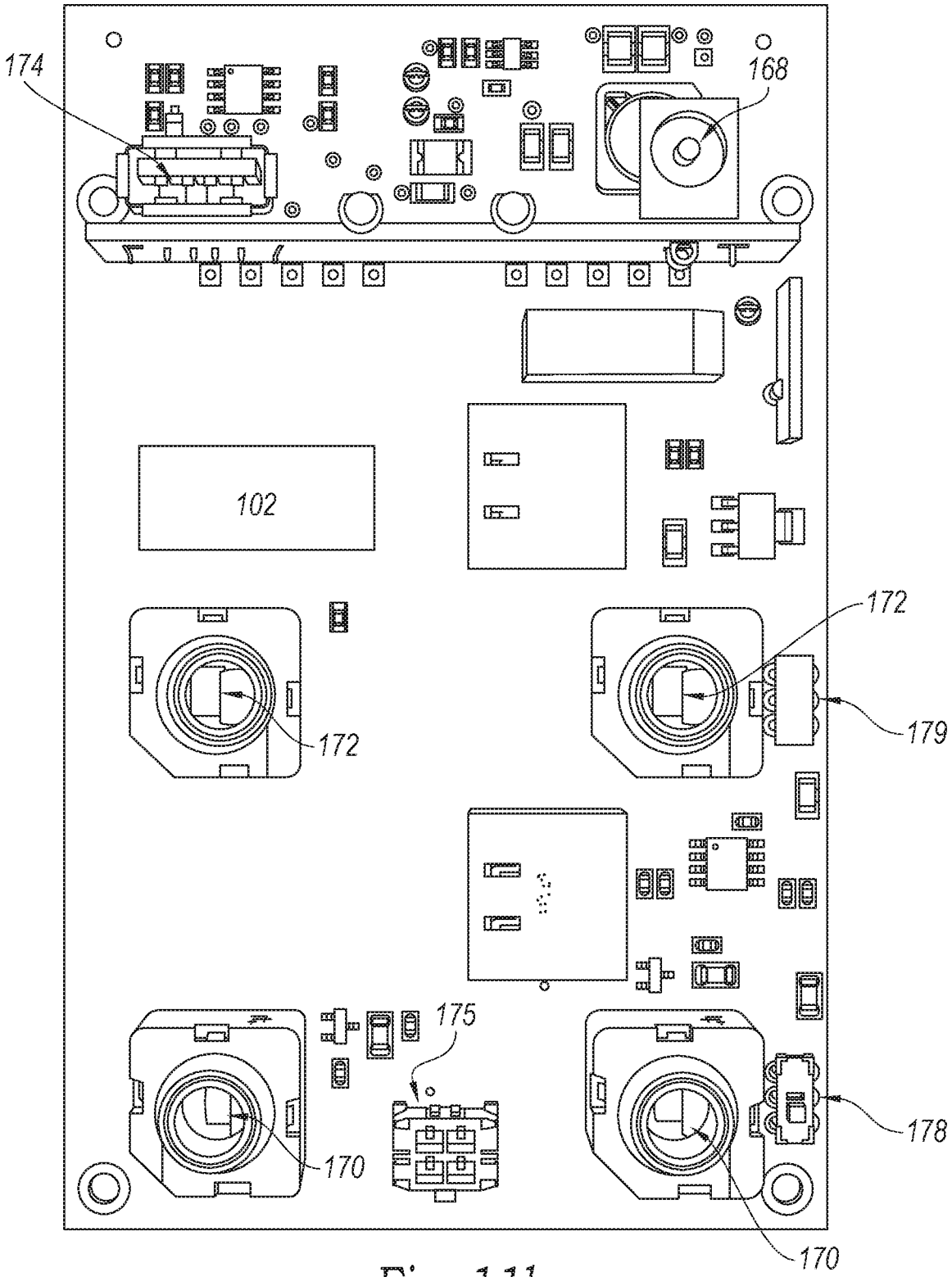

FIG. 11*b* is an input/output circuit board consistent with the technology of the present application.

Figure 12:
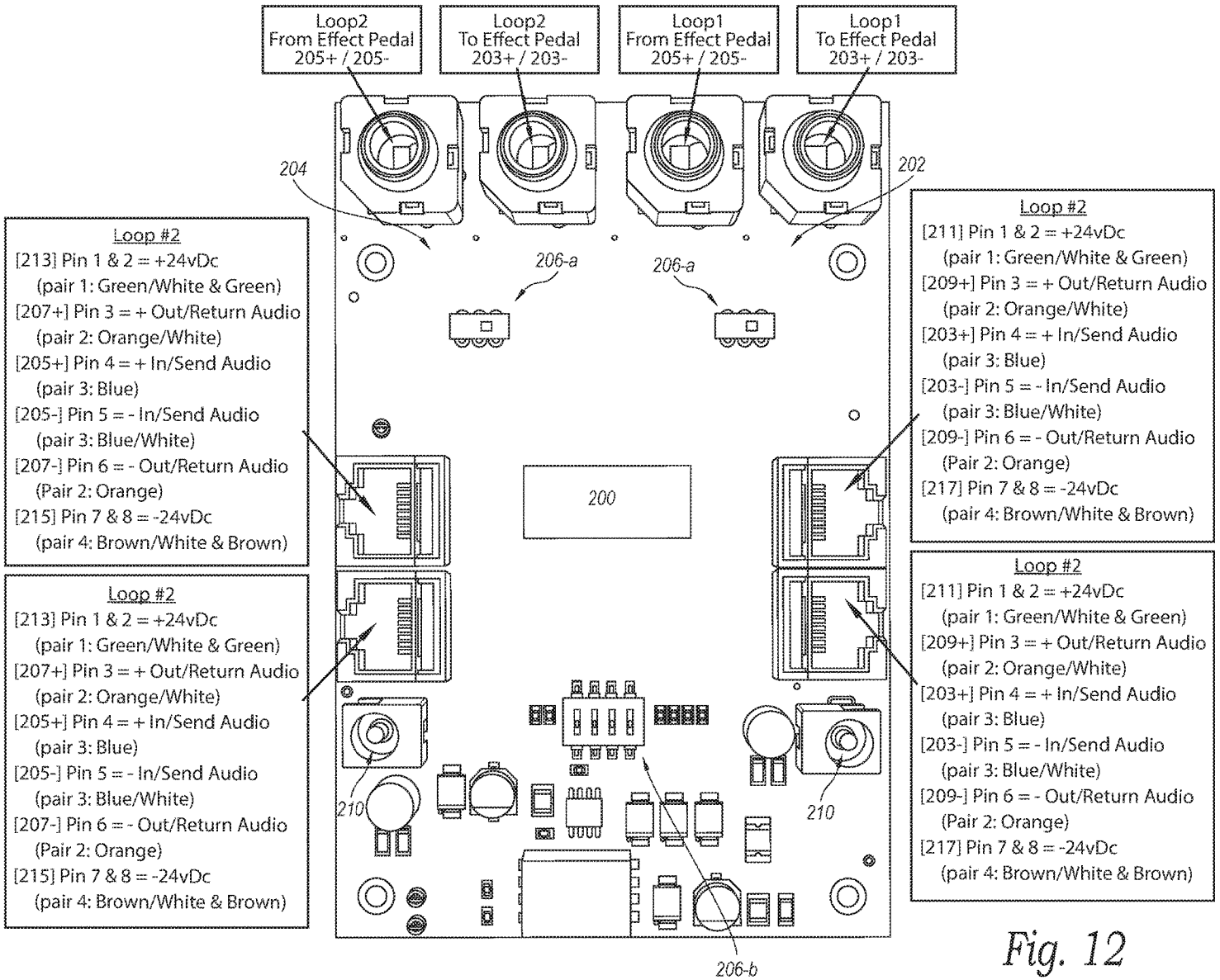

FIG. 12 is a circuit board consistent with the technology of the present application.

Figure 13:
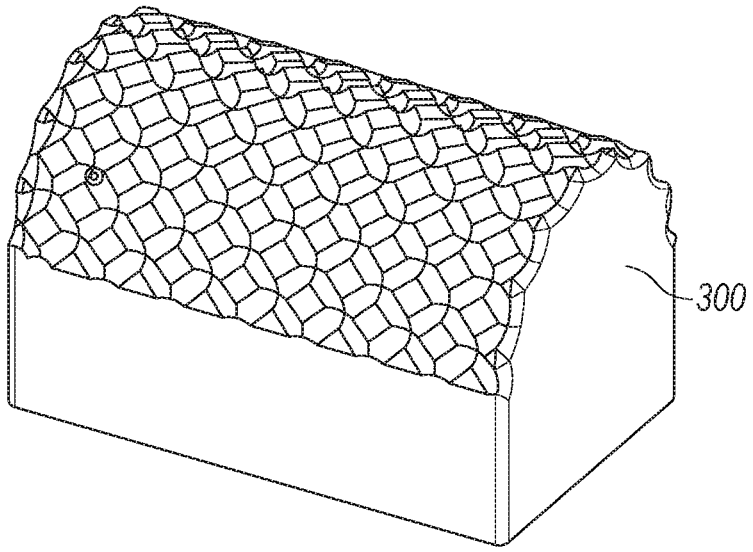

FIG. 13 is a boss usable with the technology of the present application to facilitate operation.

Figure 14:
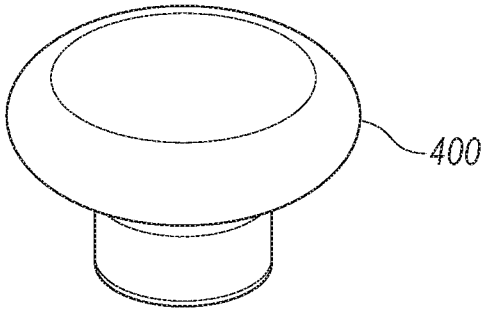

FIG. 14 is an oversized button usable with the technology of the present application to facilitate operation.

Figure 1:
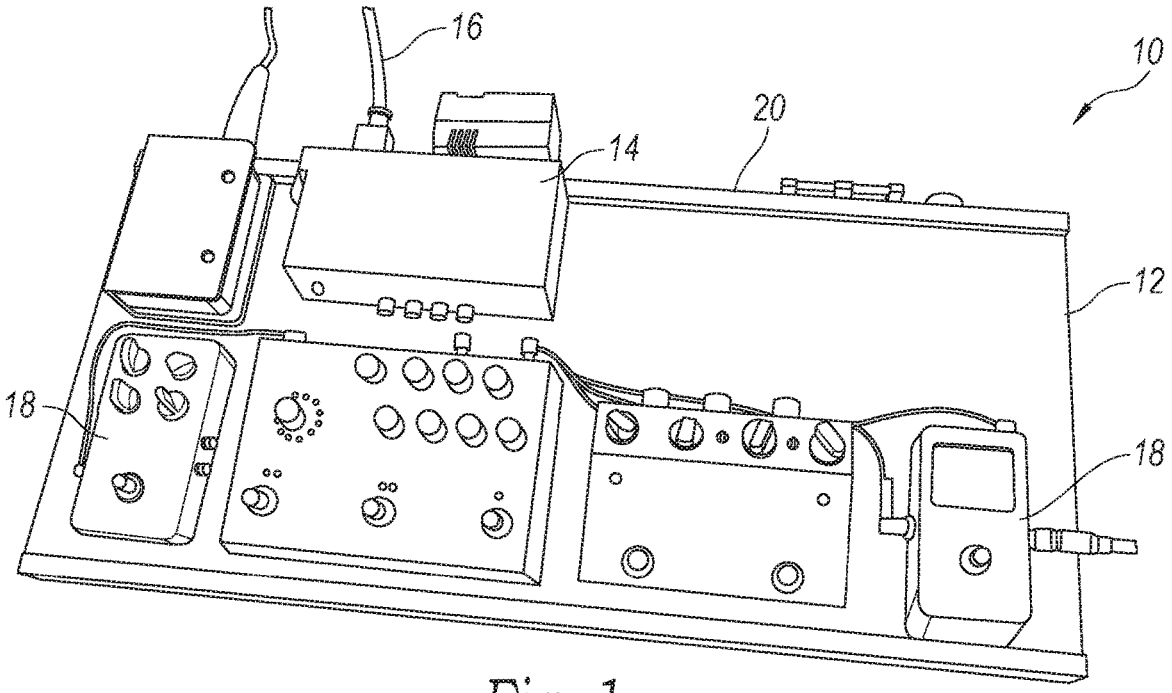
Fig. 1 (Prior Art)
FIG. 1 is a view of a conventional pedalboard.
Figure 2:
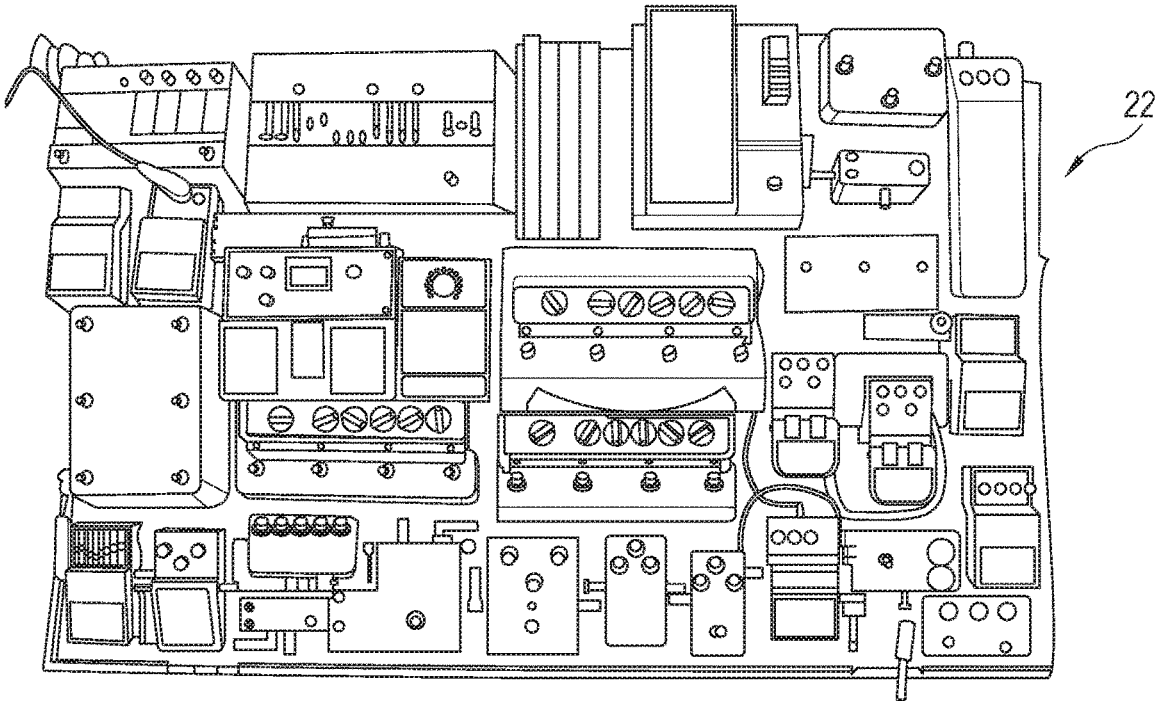
Fig. 2 (Prior Art)
FIG. 2 is a view of another conventional pedalboard.
Figure 3:
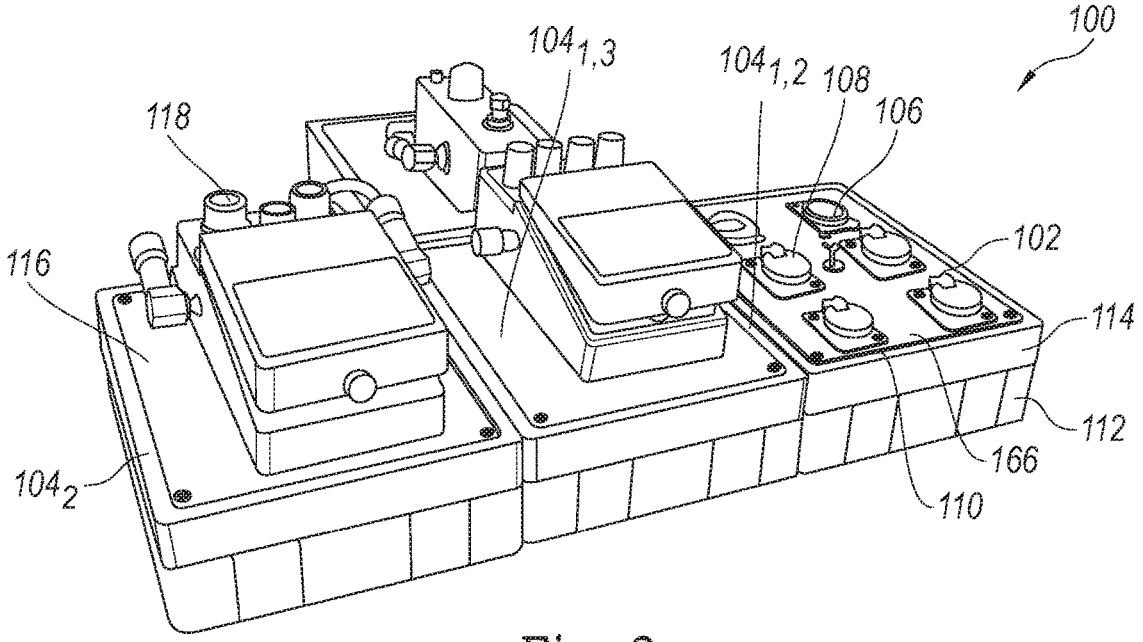
FIG. 3 is a perspective view of a modular pedalboard consistent with the technology of the present application.
Figure 15:
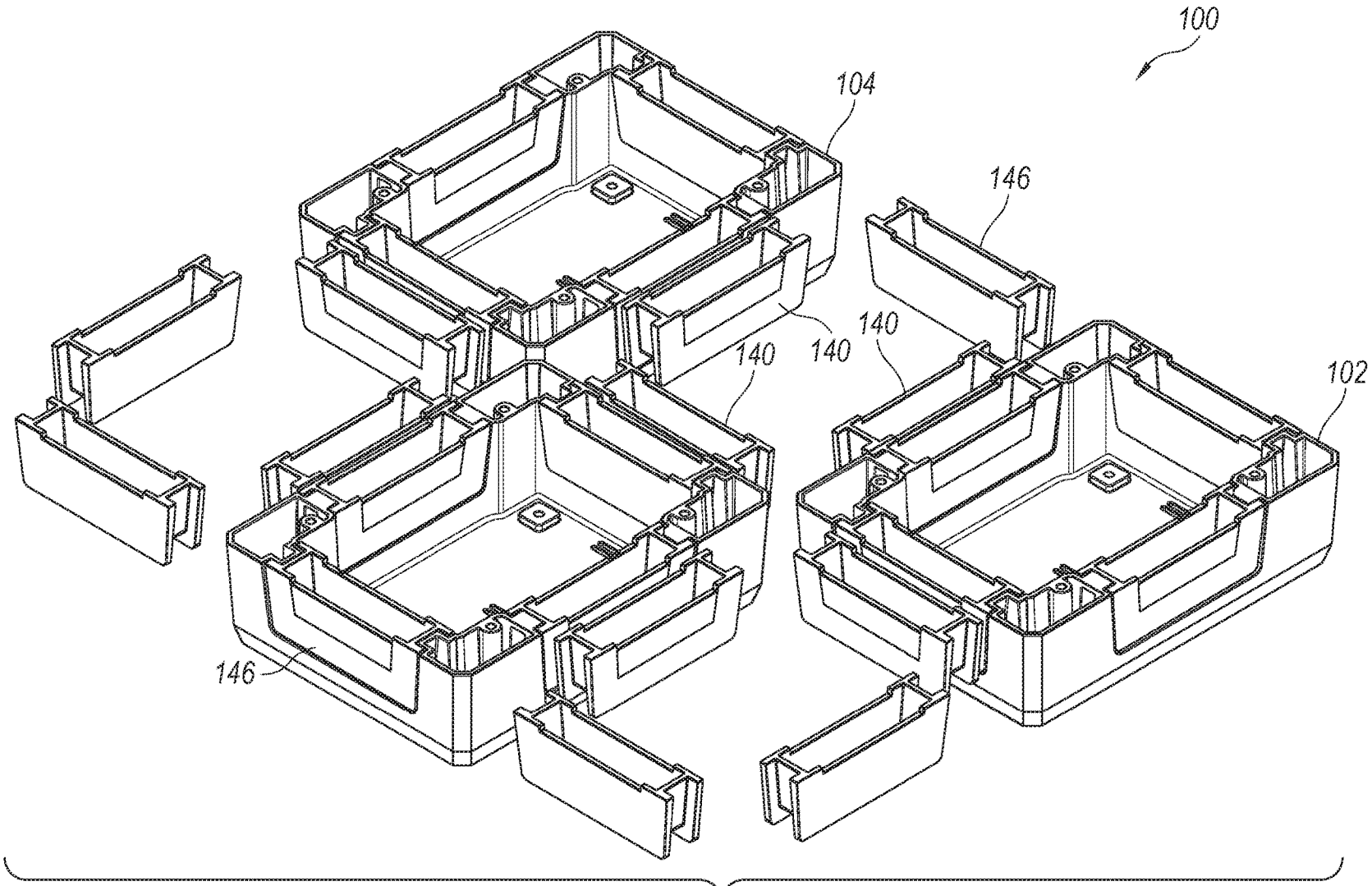

FIG. 15 shows the modular pedalboard of FIG. 3 with portions removed to show mechanical connections.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a pedalboard to mount guitar effects pedals, some of which have been mentioned above. However, the technology described herein may be used for other instruments, and the like. For example, the technology of the present application may be applicable to pedals for synthesizers, bass instruments, other string instruments, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 4:
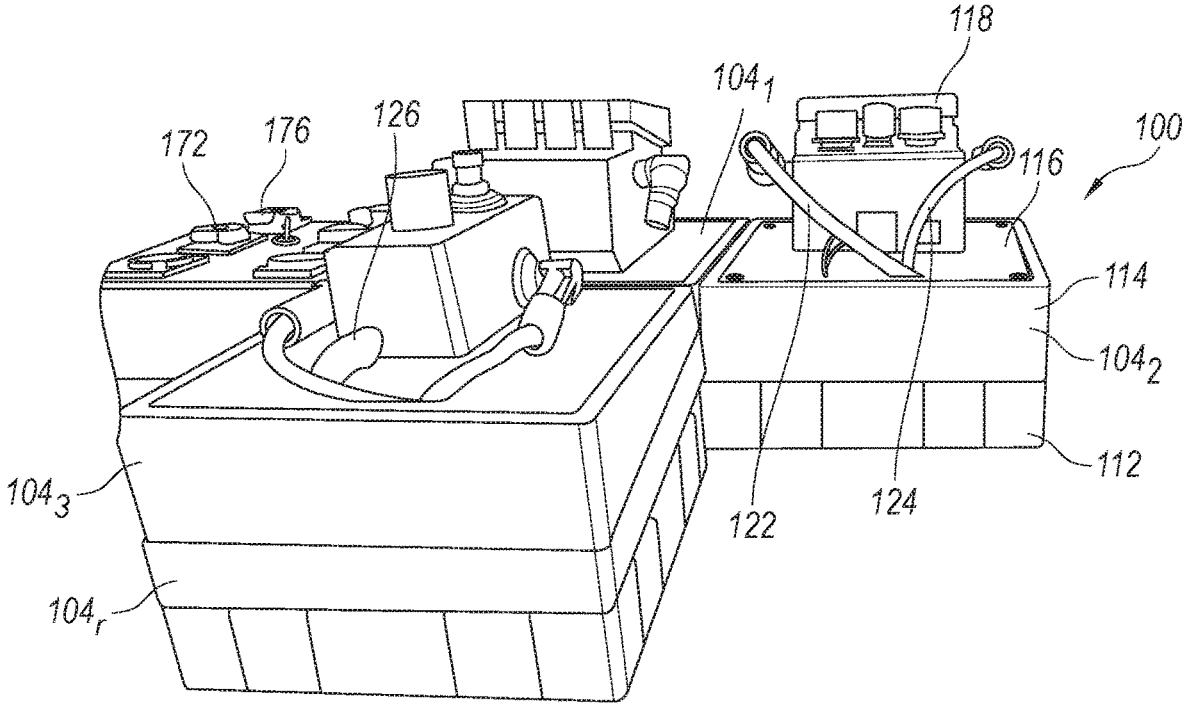
FIG. 4 is another perspective view of the pedalboard of FIG. 3.

With reference now to FIGS. 3 and 4, a modular electric guitar pedalboard ("pedalboard") 100 consistent with the technology of the present application is provided. The pedalboard 100 in this exemplary embodiment comprises a power/audio distribution pod 102 and five (5) effect pedal pods $\mathbf{104}_{1\text{-}5}$, which may be generically referred to as pods or pedal pods. The power/audio distribution pod 102 includes at least one power input 106, which is a pin socket as shown but can be any conventional connection, and at least one audio input 108 and audio output 110, which forms an input/output loop. The power/audio distribution pod 102 is shown as having two loops although only one is possible and more than two are possible. The power/audio distribution pod 102 may be split into separate pods although they are shown combined for convenience. While five (5) effect pedal pods 104 are shown in the exemplary pedalboard 100, more (or less) can be attached. Also, the arrangement of the five (5) effect pedal pods 104 and the power/audio distribution pod 102 may be altered after the original layout as desired by, or even on a whim of, the musician.

Each of the pods comprises a base 112 and a wedge 114 to form a pod. A pod plate 116 is either integrated (top) into the wedge 114 or separately attachable (cover) to the wedge 114. The wedge 114 is provided for ease of use of the pedals. The wedge 114 could be substantially flat or substantially angulated between about 0 and 45 degrees. The angulation of the wedge 114 may require a riser 114*r* (FIG. 3) be provided in a second row of pods to allow access, such as shown on power/audio distribution pod 102, which is also installed on pods $\mathbf{104}_{1\ and\ 2}$, although not labeled or specifically seen/shown. The riser 114*r* would be larger or smaller depending on the angulation, if any, of the wedge 114 and the number of rows of pods. As best seen in FIG. 4, the effect pedal 118 is connectable to the pod plate 116. The effect pedal 118 may be connected using an adhesive, a hook and loop fastener, pins, screws, or the like. Because the pods are releasably coupled themselves, the effect pedal 118 may be permanently coupled to a pod plate 116.

Figure 5:
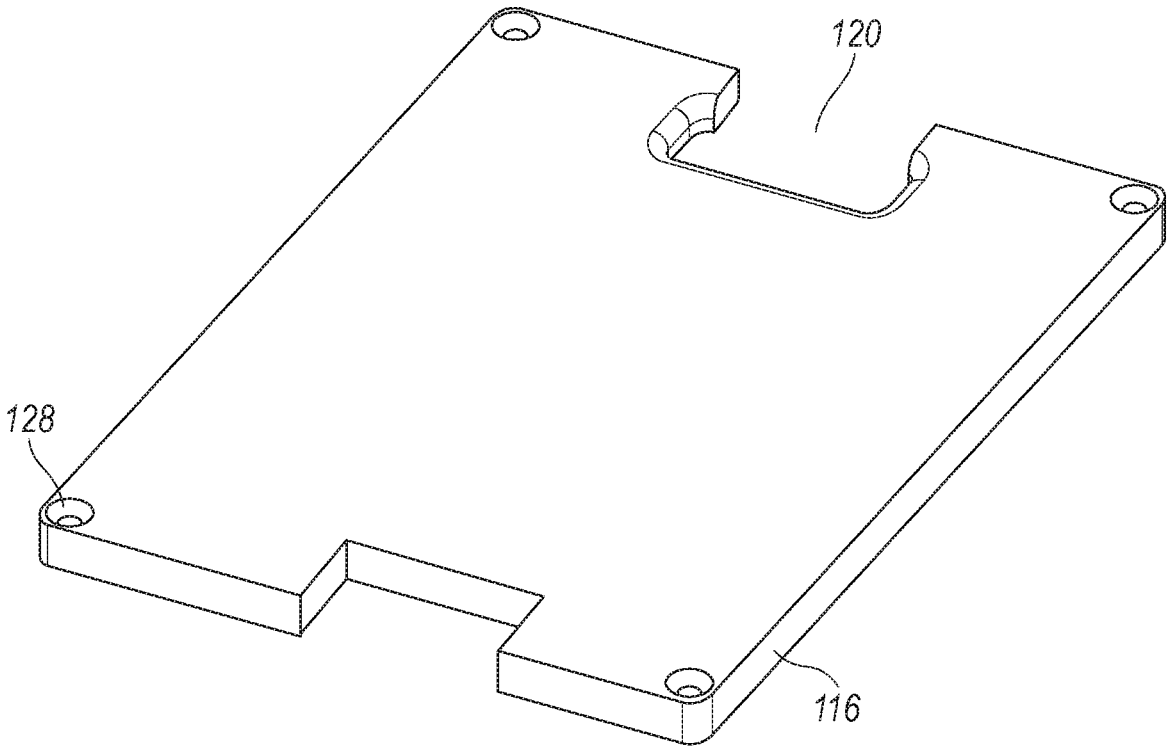
FIG. 5 is a pod plate consistent with the technology of the present application.

As best seen in FIG. 4, the pod plate 116 has a port 120. The port 120 provides access to an interior of the base 112 for an audio cable in 122, an audio cable out 124, and a power cable 126 to connect the effect pedal 118 to an electrical board contained in the base 112, which will be explained further below (cables best seen in FIG. 4). As best seen in FIG. 5, the pod plate 116 as shown is a cover and provides four bores 128. The four bores are alignable with bores in the wedge 114 such that a fastener, such as a screw, pin, or the like, can couple the pod plate 116 to the wedge 114. The port 120 in the pod plate also is shown in FIG. 5.

Figure 6:
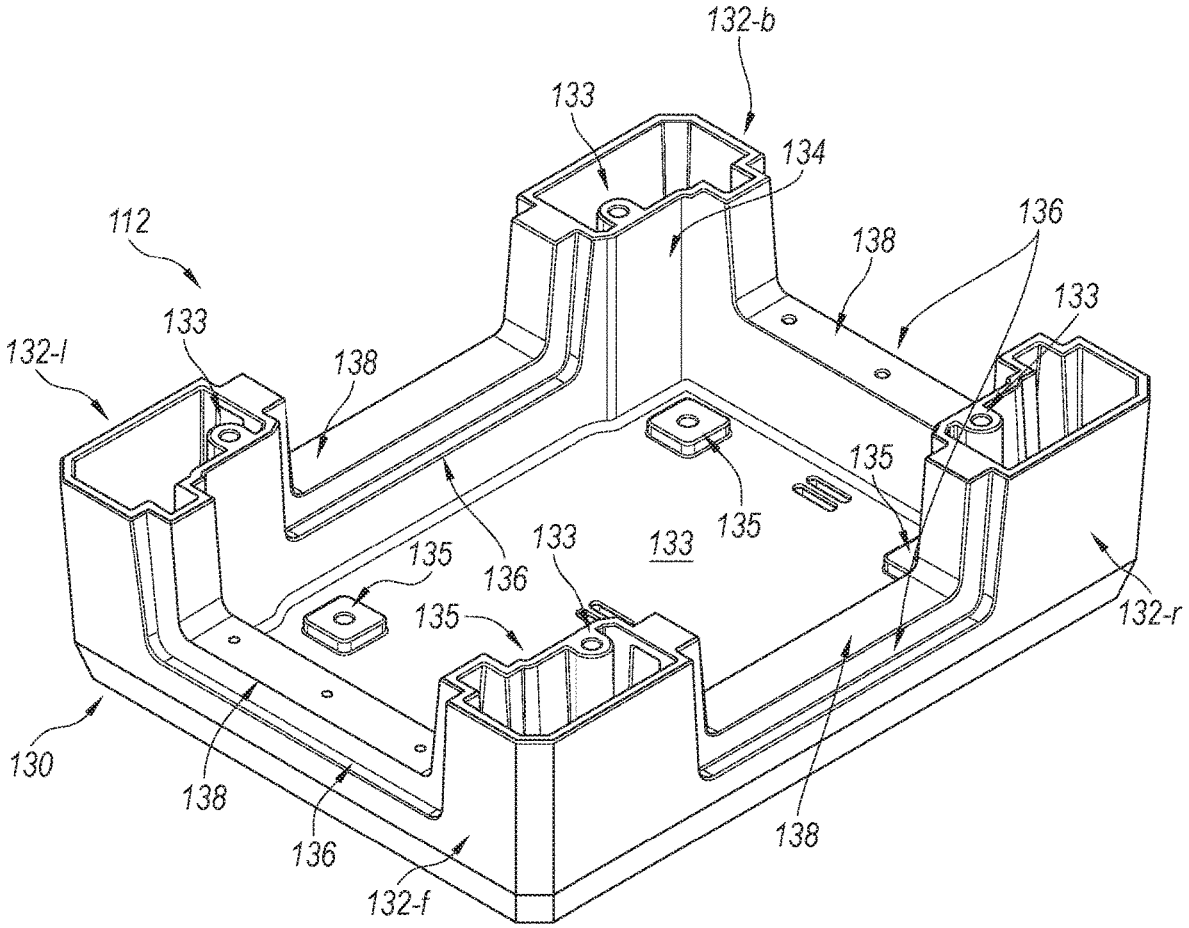
FIG. 6 is a base consistent with the technology of the present application.
Figure 7:
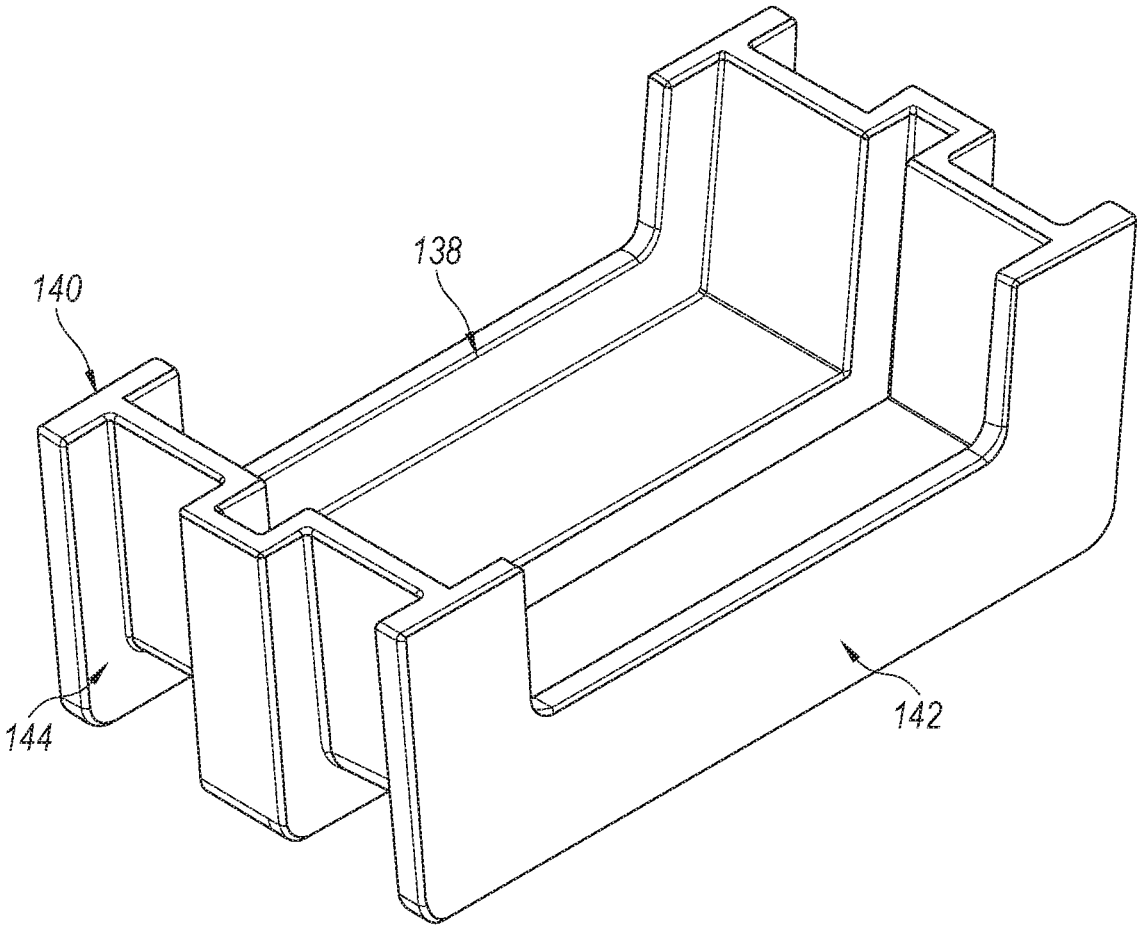
FIG. 7 is a key or coupler consistent with the technology of the present application.
Figure 8:
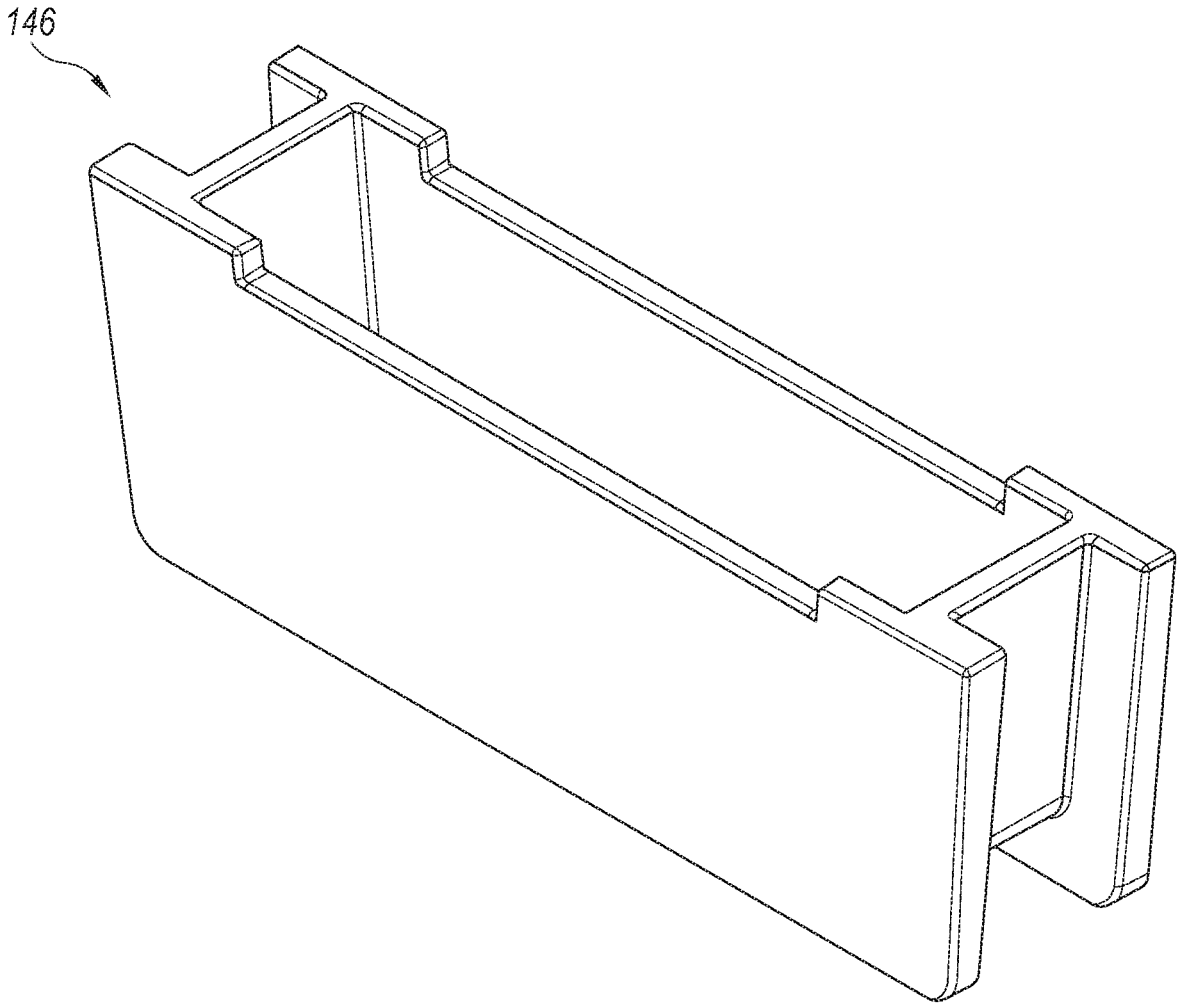
FIG. 8 is a cap consistent with the technology of the present application.

FIG. 6 shows a perspective view of the base 112. The base 112 has a bottom panel 130 and a plurality of sidewalls 132 defining a cavity 134 with a bottom 133 having support protrusions 135. The support protrusions 135 are provided to support a circuit board, described below, and allow air circulation over and under the circuit board to dissipate heat. The area under the circuit board also acts as a sump for any moisture that may enter the pod. While shown as a series of protrusions 135, the means for supporting the circuit board could be a shelf or ledge, a snap connection, or the like keeping the circuit board off the base. As shown there are four sidewalls 132, a front wall 132*f*, a left wall 132*l*, a back wall 132*b*, and a right wall 132*r*. The base 112 is shown generally square, but couple be other polygonal shapes. The terms bottom, top, front, back, left, and right are to provide orientation for explanation purposes and should not be considered limiting. The sidewalls 132 each have a plurality of slots 136 and a plurality of channels 138. The sidewalls 132 also have bores 133 to receive fasteners. The slots 136, which may be considered a first part of a connector, are designed to receive a key 140, shown in FIG. 7. The slot and key, or tongue and groove, connector is an exemplary means of releasably connecting the bases. With reference to FIGS. 3 and 4, when bases 112 are arranged next to each other, the key 140, which may be considered a second part of a connector, extends between aligned slots 136 of the base 112 to couple one pod 102/104 to another pod 102/104. The key 140 is an elongated member 142 with flanged ends 144 such that the key 140 is shaped similar to a Keystone. The channels 138 align pod to pod and provide an access port for connectors to connect the power and audio between pods as will be explained further below. To the extent a key 140 is not used in a slot 136, the slot 136 may be filled with a cap 146 as shown in FIG. 8. The cap 146 is similar to key 140 but shorter as it only extends across one sidewall 132 rather than two sidewalls side by side.

As shown, the base 112 and key 140 system allows for multiple orientations of any particular base 112. In the alternative, base 112 may have sidewalls with an integrated protrusion with a flanged end rather than a slot 136 to receive the key 140. For example, with reference to FIG. 3, center pod $\mathbf{104}_1$ may have protrusions 136*p*, which may be considered the second part of the connector, on the left wall 132*l* that are received by a slot 136, which may be considered the first part of the connector, in the right wall 132*r* of the left pod $\mathbf{104}_2$. As can be appreciated the slot and key configurations are examples of a means for releasably connecting the bases. Means other than the tongue and groove or dovetail connection may include a snap fit connection, an elastic tab and notch, male protrusions and female socket snaps, magnetic strips in each base, slide locks, or the like.

FIG. 15 shows the pedalboard 100 of FIG. 3 with certain components removed. The pods 102/104 are coupled using a plurality of keys 140. The end pods 102/104 additionally have caps 146.

Figure 9:
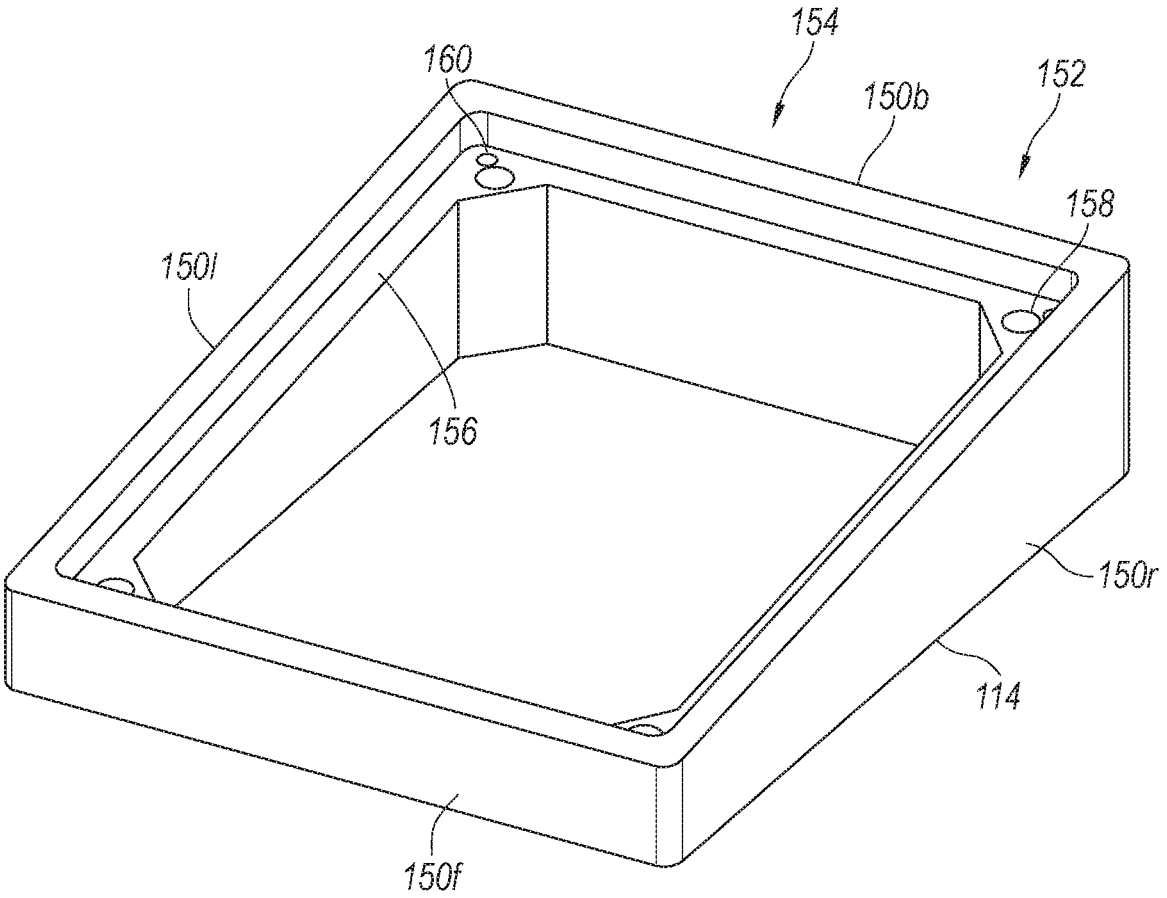
FIG. 9 is a wedge consistent with the technology of the present application.
Figure 10:
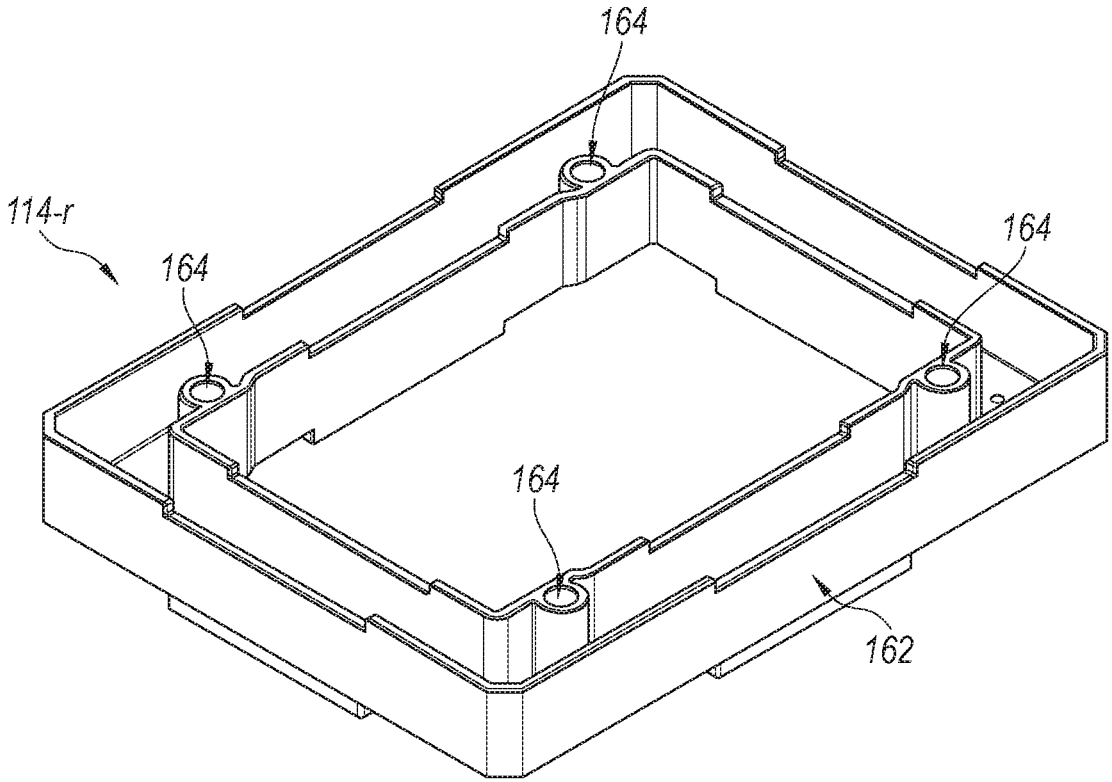
FIG. 10 is a riser consistent with the technology of the present application.

FIG. 9 shows a detail of the wedge 114. The wedge 114 has four sidewalls 150 in this exemplary embodiment. The sidewalls 150 include a front wedge wall 150*f*, a left wedge wall 150*l*, a back wedge wall 150*b*, and a right wedge wall 150*r*. The left wedge wall 150*l* and the right wedge wall 150*r* have a smaller height in the front and increase to a larger height in the back as shown, although the change may be minimal or non-existent. The back wedge wall 150*b* generally has a height larger than the front wedge wall 150*f*. To allow interchangeability in wedges for a multiple row pedalboard 100, the riser 114*r* (FIG. 10) has a height H equal to the difference between the front wedge wall 150*f* height and the back wedge wall 150*b*. The wedge 114 has a bore 152 and a counter bore 154 to provide a shelf 156 on which the pod plate 116 can sit if the pod plate is not integrated with the wedge 114. The wedge 114 has connector bores 158 to align with the bores 133 of the base 112 and connector bores 160 to align with the bores 128 of the pod plate 116 if the pod plate is not integrated with the wedge 114. FIG. 10 shows the riser 114*r* that is usable with wedge 114. The riser 114*r* is similarly shaped to the wedge 114 with front, left, back, and right sidewalls 162. The sidewalls 162 have connector bores 164 that align with the connector bores 158 of the wedge and bores 133 of the base 112.

As seen in FIG. 3, the power/audio distribution pod 102 is shown as having the base 112, a riser 114*r*, and the wedge 114 as well as an input/output plate 166, which is best shown in FIG. 11*a*. The input/output plate 166 is shown in detail in FIG. 11*a*. The input/output plate 166 may be integrated with the wedge 114 (a top) or removably coupled to the wedge 114 (cover) similar to the pod plate 116. The input/output plate 166 has a power port 168, at least one audio in port 170, at least one audio out port 172, and a power output port 174, which may be a conventional plug or a USB power/data port as shown. The power port 168 is configured to receive a cable connected to conventional grid or house power. The power port 168 is electrically coupled to a circuit board, as will be explained further below. The audio in port 170 is configured to receive a plug from a musical instrument, such as an electric guitar. The audio out port 172 is configured to receive a plug from an output source, such as an amplifier as is known in the art. As shown, the overall system may have one (1), two (2), or more audio loops. The audio signal from the instrument, such as the electric guitar, would be received via the audio in plug 170. The audio in plug 170 would be electrically coupled to a circuit board, as will be explained further below, to send the signal to the various effects pedals electrically coupled in the audio loop. The audio out plug 172 would be electrically coupled to the circuit board, as will be explained further below, and will receive the signal after the signal is modified/modulated by the effects pedals. The signal, as modified, would be transmitted to the amplifier and converted to sound (hopefully music). The audio portion of the power/audio distribution pod 102 also includes a switch 175 as shown in FIG. 11*b*. In this exemplary embodiment, the switch 175 provides a first position where audio loop 1 and audio loop 2 are separate audio loops. Each of the 2 audio loops may be coupled to different effect pedals or similar effect pedals. The switch 175 provides a second position where such that audio loop 1 is coupled as input to the two (2) separate audio loops. Audio input 2, in this case, would be disabled. Of course, other combinations and switch positions are necessary for more audio input possibilities.

A circuit board 200 is shown in FIG. 12. While shown as a circuit board 200, the connections could be formed using other devices, such as cable connectors, ribbon cable, etc. Circuit board 200 has one or more audio loops. In this exemplary embodiment, circuit board 200 has a first audio loop 202 (shown by Loop 1) and a second audio loop 204 (shown by Loop 2). Each audio loop has a signal in positive (+) connector 203+ electrically coupled to a signal out positive (+) connector 205 and a signal in negative (−) connector 203− electrically coupled to a signal out negative (−) connector 205−. The signal in connector 203+, 203− is coupled, via a cable or the like, to the signal out connector 205+, 205− of the previous pod or directly to the audio in port 170 of the power/audio distribution pod 102. The signal out connector 205+, 205− is coupled, via a cable or the like, to the signal in connector 203+, 203− of the subsequent pod. Each audio loop also has a return in positive (+) connector 207+, a return in negative (−) connector 207−, a return out positive (+) connector 209+, and a return out negative (−) connector 209−. The return out 209+, 209− is coupled, via a cable or the like, to the return in connector 207 of the subsequent pod or to the audio out port 172 of the power/audio distribution pod 102. The return in connector 207+,

207– is coupled, via a cable or the like, to the return out 209+, 209– of the previous pod. For the end of the line, the connectors 205+, 205– and connectors 207+, 207– are shunted or jumped to close the loops.

With reference to the first audio loop 202, the audio signal from the musical instrument, such as an electric guitar, flows from the audio in port 170 to the signal in connector 203+, 203– of an effect pedal pod 104. The effect pedal pod 104 is coupled to the terminals of the circuit board such that the audio signal flows into the effect pedal though a signal out connector 205+, 205–, such as through aforementioned cable 122. The effect pedal modifies the audio signal and returns the signal via a return connector 207+, 207– to the signal out connector 205+, 205– through another connector, such as through the aforementioned cable 124. The modified audio signal may continue to the next pod or be returned via the return connectors. In particular, the modified audio signal is returned via return in connector 207 to the return out connector 209. A switch 206*a* may be used to control whether the audio signal is passed through the effects pedal or the effects pedal is bypassed and continues downstream to additional pods or returned.

Similarly, the circuit board 200 has a power terminal 210, with a positive and negative, to supply power to each connected pod. The power terminal 210 has a positive connector in 211 and a positive connector out 213 as well as a negative connector in 217 and a negative connector out 215. The power port 168 would have a supply or positive terminal connected to the positive connector in 211 and a return or negative terminal connected to the negative connector out 217 via a cable or the like. A subsequent pod would have its positive connector in 211 coupled, via a cable or the like, to the positive connector out 213 of the previous pod. The subsequent pod would have its negative connector out 217 coupled, via a cable or the like, to the negative connector in 215 of the previous pod. A switch 206*b* has four (4) positions with a combination of five (5) output voltage potentials, 5 volts, 9 volts, 12 volts, 15 volts, 18 volts DC. The voltage potentials are exemplary and should not be considered limiting as other voltage combinations are possible and would be determined by pedal requirements and/or country requirements.

While the voltage on the circuit board 200 is shown as a 24 volt DC power supply, which is not consistent with many effect pedals, the voltage supplied may be any voltage, such as for example, 5 volts DC, 9 volts DC, 12 volts DC, 15 volts DC, 18 volts DC when selected via switch 206*b*. Additionally, a step up transformer may be provided. The step up transformer (not shown) may increase the voltage from, for example, 9 volts DC to 24 volts DC. The step up transformer, which may be a step down transformer in certain embodiments, increases the voltage for the individual pod. While the present arrangement contemplates DC power, the technology described herein may be converted to provide AC power on power terminal 210.

With reference back to FIG. 11*a*, the power/audio distribution pod 102 is shown as having a power output socket 174, which is shown as a USB socket although any socket is possible. Peripheral devices may be coupled to the power output socket 174, such as, for example, a light to provide illumination such that the musician can see the various pedals. With that in mind, the pod plate 116 and/or the input/output plate 166 may be formed from a reflective, phosphoric material, or other glow in the dark material to facilitate the use of the effect pedal by the musician.

With reference back to FIGS. 3 and 4, it can be appreciated that operation of the effect pedals mounted to the pods 104 may be difficult in view of the numerous dials, buttons, and setting knobs on each effect pedal. Further, as rows of pods 104 are added, the movement from one row to the next may be difficult. FIG. 13 shows a boss 300 that may be attached to an effect pedal actuator to facilitate operation of the effect pedal mounted to the pod 104. FIG. 14 shows an oversized button 400 that may be attached to an effect pedal actuator to facilitate operation of the effect pedal mounted to the pod 104.

Figure

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A plurality of modular pods for a pedalboard comprising, at least two bases where each of the at least two bases comprise a bottom and a sidewall defining a cavity, the sidewall having at least one channel and a slot defining a slot shape;

at least one key sized to extend from the slot of one of the at least two bases to the slot of the other of the at least two bases having a key shape where the key shape cooperatively engages the slot shape to releasably couple the at least two bases; and a pod plate operatively coupled to the base covering the cavity, the pod plate having at least one port configured to provide access to the cavity.

2. The plurality of modular pods of claim 1 wherein each of the at least bases comprise a circuit board in the base comprising at least one audio loop and at least one power terminal, wherein the circuit board is adapted to receive an audio signal and power and wherein the circuit board is adapted to supply an audio signal and power from the circuit board to an effect pedal.

3. The plurality of modular pods of claim 2 wherein the circuit board has a plurality of audio loops.

4. The plurality of modular pods of claim 1 wherein the slot shape and key shape are operatively designed to form a tongue and groove connection.

5. The plurality of modular pods of claim 4 wherein each of the at least one key comprises an elongated member having a pair of opposed fanged ends.

6. The plurality of modular pods of claim 1 wherein the each of the at least two bases comprise four sidewalls defining a rectangular cavity and wherein each of the four sidewalls have the channel and the slot.

7. The plurality of modular pods of claim 6 wherein each of the channels and slots that are not coupled to the at least one key has a cap operatively engaged with the slot.

8. The plurality of modular pods of claim 7 wherein the cap shape is ½ of the key shape.

9. A modular pedalboard comprising:

at least one power or audio distribution pod comprising a base and an input or output plate operatively coupled to the base, the input or output plate having a power port configured to receive power, at least one audio in port configured to receive an audio signal from an electric instrument, and at least one audio out port, the power or audio distribution pod having a least one audio loop operatively coupled to the audio in port and the audio out port;

at least one effects pedal pod operatively coupled to the at least one power or audio distribution pod, the effects pedal pod comprising a base and a pedal pod plate operatively coupled to the base, the pedal pod plate configured to receive at least one effects pedal, the pedal pod plate configured such that the at least one effects pedal is couplable to the audio port and the power port of the at least one power or audio distribution pod; and at least one key releasably coupling the at least one power or audio distribution pod and the at least one effects pedal pod.

10. The modular pedalboard of claim 9 wherein the at least one power or audio distribution pod comprises a power distribution pod and an audio distribution pod.

11. The modular pedalboard of claim 9 wherein the at least one effects pedal pod comprises a riser.

12. The modular pedalboard of claim 9 wherein the at least one power or audio distribution pod and the at least one effects pedal pod have alignable slots sized to releasably engage the at least one key.

13. The modular pedalboard of claim 12 wherein the slot and key form a tongue and groove connection.

14. A modular pedalboard comprising:

at least one power and audio distribution pod, the at least one power and audio distribution pod comprising:

a base having comprising a bottom and a sidewall defining a cavity that is adapted to receive a cable, and an input and output plate operatively coupled to the base, the input output plate configured to receive at least one conductor that transmits power and an audio signal from an electric instrument;

a plurality of modular pods, each of the plurality of modular pods comprising:

a base comprising a bottom and a sidewall defining a plurality of cavities, the sidewall having at least one channel that is adapted to receive a conductor that is configured to operatively couple an effects pedal to the at least one power and audio distribution pod such that the effects pedal receives power and the audio signal;

a pod plate operatively coupled to the base covering the cavity, the pod plate having at least one port configured to provide access to the cavity; and a plurality of keys operatively sized to releasably engage the plurality of cavities to operatively couple the at least one power and audio distribution pod and the plurality of modular pods.

15. The modular pedalboard of claim 14 wherein the circuit board comprises a power switch that converts the power to a voltage usable by a corresponding effects pedal.

16. A modular pod for a pedalboard comprising, a base comprising a bottom and a sidewall defining a cavity, the sidewall having at least one channel and a slot in the sidewall a protrusion extending from a portion of the sidewall generally opposite the slot, wherein the slot is sized to cooperatively engage a protrusion from a first adjacent base and the protrusion is sized to cooperatively engage a slot in a sidewall of a second adjacent base to allow the base to be coupled to at least one or both of the first adjacent base or the second adjacent base; and a pod plate operatively coupled to the base covering the cavity, the pod plate having at least one port configured to provide access to the cavity.

* * * * *